United States Patent [19]

Kiewert et al.

[11] 4,122,025

[45] Oct. 24, 1978

[54] LIQUID SCOURING CLEANING COMPOSITIONS CONTAINING CRISTOBALITE

[75] Inventors: Eva Kiewert, Dusseldorf; Karlheinz Disch, Haan, both of Germany

[73] Assignee: Henkel Kommanditgesellschaft auf Aktien, Dusseldorf-Holthausen, Germany

[21] Appl. No.: 791,225

[22] Filed: Apr. 27, 1977

[30] Foreign Application Priority Data

Apr. 29, 1976 [DE] Fed. Rep. of Germany ..... 2618977

[51] Int. Cl.[2] ..... C11D 1/66; C11D 3/14; C11D 3/37; C11D 17/08

[52] U.S. Cl. ..... 252/173; 51/308; 252/89 R; 252/131; 252/140; 252/155; 252/DIG. 2; 252/DIG. 14

[58] Field of Search ..... 252/89, 99, 131, 140, 252/155, 173, DIG. 2, DIG. 3, DIG. 14, DIG. 15; 51/308

[56] References Cited

U.S. PATENT DOCUMENTS

| | | | |
|---|---|---|---|
| 2,907,651 | 10/1959 | Black | 75/122 X |
| 2,945,815 | 7/1960 | Diaz | 252/558 X |
| 3,281,367 | 10/1966 | Jones | 252/112 |
| 3,520,818 | 7/1970 | Cambre | 252/113 |
| 3,522,186 | 7/1970 | Cambre | 252/112 |
| 3,677,954 | 7/1972 | Nakajima | 252/121 |
| 3,997,460 | 12/1976 | Sirine | 252/106 |
| 4,028,261 | 6/1977 | Peterson | 252/89 |

OTHER PUBLICATIONS

Latimer, W. M., et al.: *Reference Book of Inorganic Chemistry, Third Edition*, published by the MacMillan Co., 1951, pp. 314 & 315.

Rompp, H.: Chemie Lexikon, Band III, p. 4341.

*Primary Examiner*—Dennis L. Albrecht

*Attorney, Agent, or Firm*—Hammond & Littell

[57] ABSTRACT

Liquid scouring cleaning compositions containing 30% to 60% by weight of cristobalite having a grain size of less than 150 $\mu$, a surfactant, a thickening agent, and a liquid carrier, which compositions are white, stable suspensions.

6 Claims, No Drawings

LIQUID SCOURING CLEANING COMPOSITIONS CONTAINING CRISTOBALITE

THE RELATED ART

Cleaning agents which have a scouring action, and which are used for the cleaning of very dirty, hard surfaces, contain as an essential constituent a water-insoluble mechanically-cleansing abrasive component in admixture with a component which has a cleaning action in aqueous solution. The scouring effect of this abrasive component is chiefly determined by the hardness of the material and the size of grain. Thus, pulverized minerals, such as mineral meal of marble, dolomite, feldspars and calcspars, as well as quartz sand are used for scouring agents having a particularly effective cleaning action. These minerals have a more or less pronounced inherent color, so that the products produced with these minerals have a usually undesirable grey or brown tint. The low degree of whiteness of such products generally deteriorates when these products are suspended in water. In the case of liquid products, this phenomenon causes an unsightly, dirty appearance which gives the user the impression of reduced cleaning power. This disadvantage cannot even be avoided by using dyestuff additives, since this usually results in undesirable mixed colors and not in clear tints.

It is also known to improve the low degree of whiteness of these scouring agents by the use of additives, such as optical brighteners or so-called white pigments such as titanium dioxide, zinc oxide or zinc carbonate. However, this measure has proved to be unsatisfactory and also leads to a considerable increase in the cost of the final product.

A further disadvantage of the natural mineral powders or meal, which combine great mineral hardness with a good scouring effect, is their high specific gravity which impairs the suspension stability and thus the storage stability of liquid products.

OBJECTS OF THE INVENTION

An object of the present invention is the development of liquid scouring cleaning compositions which are white, stable suspensions, thus overcoming the disadvantages of the previously known compounds.

Another object of the present invention is the development of a liquid scouring cleaning composition consisting essentially of:

(a) from 30% to 60% by weight of cristobalite having a grain size of less than 150 $\mu$,
(b) from 1% to 10% by weight of at least one surfactant selected from the group consisting of anionic surface-active compounds, zwitterionic surface-active compounds and non-ionic surface-active compounds,
(c) from 0.1% to 2% by weight of an organic thickening agent, and
(d) from 27% to 68.9% by weight of a predominantly aqueous liquid carrier.

These and other objects of the invention will become more apparent as the description thereof proceeds.

DESCRIPTION OF THE INVENTION

We have now found that cristobalite, a modification of silicon dioxide, is, in a finely distributed form, eminently suitable as an abrasive component for liquid cleaning compositions having a scouring action. In addition to having the high degree of hardness of 6.5 in accordance with Mohs' scale of hardness, which is required for a satisfactory cleaning effect, cristobalite also has a very high degree of whiteness which is largely maintained even when it is suspended in water. Furthermore, cristobalite has a lower specific gravity than the conventional mineral powders used as abrasive substance. By way of example, compared with quartz, whose specific gravity is 2.65, or compared with fluorite, whose specific gravity is 3.18, the use of finely distributed cristobalite having the specific gravity of 2.32 renders it possible to produce pourable liquid products which have a distinctly greater suspension stability.

The cristobalite used in the cleaning compositions in accordance with the invention is produced in a high temperature process by roasting quartz sand at temperatures in excess of 1200° C and by the iron-free grinding of the cristobalite sand, thus obtained, into a powder having the desired granular size. The cristobalite used in accordance with the invention is, crystallographically, the tetragonally trapezohedral crystal modification of silicic acid which is designated low-cristobalite or $\beta$-cristobalite.

The liquid cleaning compositions in accordance with the invention are products based on mixtures of water, a surfactant component and a thickening agent together with the abrasive substance and, if required, other additives. The compositions of the invention comprise:

30% to 60% by weight of cristobalite having a grain size less than 150 $\mu$,
1% to 10% by weight of a surfactant component comprising anionic and/or zwitterionic and/or non-ionic surfactants,
0.1% to 2% by weight of a thickening agent, and
27% to 68.9% by weight of a liquid carrier, preferably water.

More particularly, the present invention relates to a liquid scouring cleaning composition consisting essentially of:

(a) from 30% to 60% by weight of cristobalite having a grain size of less than 150 $\mu$,
(b) from 1% to 10% by weight of at least one surfactant selected from the group consisting of anionic surface-active compounds, zwitterionic surface-active compounds and non-ionic surface-active compounds,
(c) from 0.1% to 2% by weight of an organic thickening agent, and
(d) from 27% to 68.9% by weight of a predominantly aqueous liquid carrier.

Preferably, the surfactant component predominantly comprises non-ionic, surface-active compounds or tensides. Embodiments which are particularly preferred are those having a surfactant component which is composed entirely of non-ionic tensides. The content of thickening agent can be kept low in such compositions.

The term "liquid scouring cleaning compositions" refers to those liquid compositions which range from easily pourable to highly viscose and pasty cleaning agents. Those which are particularly preferred are the pourable liquid agents having a viscosity of 1000 to 8000, particularly 2000 to 5000, cP (measured with a Brookfield rotary viscosimeter at 20 r.p.m. and room temperature).

In addition to water, suitable liquid carrier substances are water-soluble organic solvents such as alkanols containing 1 to 4 carbon atoms, or alkanepolyols containing 2 to 4 carbon atoms, in quantities less than those of the water. By adding these organic solvents, one frequently obtains a substantial increase in the solubility of a portion of the water-soluble constituents, particularly the solubility of the surfactants. It is usually sufficient for the said solvents to replace from 1% to 20% by weight of the water used.

The predominantly aqueous liquid carrier present in an amount of from 27% to 68.9% by weight therefore can consist of 80% to 100% by weight of water and from 0 to 20% by weight of a water-soluble organic solvent, both based on the total aqueous liquid carrier.

Finely distributed cristobalite, suitable for the use in accordance with the invention, is in the form of cristobalite powder whose grain size is substantially less than 150 $\mu$. This is obtained by iron-free grinding and multistage sifting to obtain such a product, so that at least 95% of the cristobalite particles pass through a sieve having an inside mesh size of 150 $\mu$. Cristobalite powders which are particularly preferred are those which are substantially finer than 100 $\mu$, in grain size, i.e., those of which at least 99.5% pass through a sieve having an inside mesh size of 105 $\mu$. There is no lower limit to the grain size. Of course, a substantial proportion of particles having a grain size of less than 5 $\mu$ is not particularly desirable, since such extremely fine particles are too small to have an adequate scouring action. Preferably the grain size of the cristobalite is from 5 $\mu$ to 150 $\mu$.

The cleaning agents in accordance with the invention can also optionally contain up to 5% by weight of conventional additives from the group of water-soluble inorganic and organic bases, particularly alkali metal hydroxides, foam stabilizers, preservatives, antimicrobials, perfumes and dyes, as well as soluble inorganic alkaline reacting alkali metal salts, such as sodium carbonate, sodium bicarbonate, sodium sulfate, sodium silicate, borax and/or organic complex-forming acids, such as citric acid, gluconic acid, nitrilotriacetic acid, ethylenediaminetetraacetic acid, etc. and alkali metal salts thereof, which assist the cleaning action by the dissolving of metal oxide coatings.

The surfactant component to be used in accordance with the invention can comprise anionic, zwitterionic or non-ionic surface-active compounds or tensides and mixtures thereof. In general, the surfactant component contains at least one non-ionic tenside in amounts of from 50% to 100% of the surfactant component. In the present context, the term "anionic tensides" primarily refers to the synthetic sulfonate and sulfate surface-active compounds in addition to the alkali metal soaps. The zwitterionic surface-active compounds primarily involve betaines, i.e., derivatives of aliphatic quaternary ammonium compounds. The non-ionic surface-active compounds are primarily the polyglycol ethers and preferred are the ethoxylated $C_8$–$C_{20}$ alkanols of all types, ethoxylated $C_4$–$C_{12}$ alkylphenols and the fatty acid alkylolamides. In a wider sense, the anionic, zwitterionic and non-ionic tensides are suitable to the extent to which they will be further discussed in the description of the invention.

In the pourable liquid cleaning agents, particularly preferred within the scope of the present invention, the amount of the water-insoluble component having a mechanical cleaning action, preferably entirely comprising cristobalite having a grain size of less than 100 $\mu$, is preferably 35% to 50% by weight of the total preparation. These agents comprise a stable suspension of the cristobalite in an aqueous solution which contains 1% to 6% by weight of a surfactant component which preferably comprises only non-ionic surface-active compounds, and 0.1% to 1.5% by weight of a thickening agent, wherein the amount of water in the suspension is at least 40% by weight of the total agent. Compositions within this range exhibit optimum cleaning power and suspension stability.

The preferred composition of the invention, therefore, relates to a liquid scouring agent composition consisting essentially of:

(a) from 35% to 50% by weight of cristobalite having a grain size of less than 100 $\mu$ and over 5 $\mu$,
(b) from 1% to 6% by weight of at least one non-ionic surface-active compound,
(c) from 0.1% to 1.5% by weight of a water-soluble polycarboxylate polymeric thickening agent,
(d) from 40% to 63.9% by weight of water, and
(e) from 0 to 20% by weight of a water-soluble organic solvent.

Particularly suspension-stable liquid preparations contain a water-soluble polycarboxylate polymeric compound as the thickening agent.

This polymeric polycarboxylate acting as a thickening agent is present as an alkali salt and/or as ammonium or substituted ammonium salt in the liquid agents. In the present context, the term "substituted ammonium" refers to the salt form of primary, secondary or tertiary alkylamines having a maximum of 2 carbon atoms per alkyl radical and a maximum of 3 carbon atoms per alkylol radical, respectively. These alkylamines and alkylolamines are for example, methylamine, dimethylamine, ethylamine, diethylamine, trimethylamine, triethylamine, ethanolamine, diethanolamine, triethanolamine, 2-hydroxypropylamine, bis-2-hydroxypropylamine, 2,3-dihydroxypropylamine or bis-2,3-dihydroxypropylamine, etc. Preferred substituted ammonium salts are di- and triethanolammonium salts.

The water-soluble polycarboxylates used, in accordance with the invention, as thickening agents are polymers based on acrylic and/or methacrylic acid. In addition to the acryl or methacryl monomer units, the copolymers contain preferably differing proportions of monomer units selected from the group consisting of acrylic acid esters or methacrylic acid esters of the lower, particularly $C_1$–$C_3$ alkanols, acrylamide or methacrylamides, maleic acid or maleic acid anhydride, styrene, vinyl-lower-alkyl ethers, such as vinylmethyl ether, and the polyallyl ethers of sugar. These mixed polymerizates can be present in the form of two-component or three-component copolymers. Preferably the water-soluble polycarboxylate polymers employed are those which contain, in addition to the acryl and/or methacryl monomer units up to 75 mol percent of monomer units of a methyl, ethyl or propyl ester of acrylic acid and/or methacrylic acid, as well as copolymers from acrylic acid and polyallyl polysugar ether monomer units, the latter amount to 0.2% to 2.5% by weight of the polymer.

Adequate solubility in aqueous alkalis is obtained in the copolymers of acrylic acid or methacrylic acid with the lower alkyl esters of these acids when the content of the acryl or methacryl monomer units in the copolymer amounts to at least 25 mol percent. Preferably, this content is at least 30 mol percent, whereby these preferred copolymers can also contain styrene monomer units. Suitable copolymers of this type comprise, for example, methacrylic acid and methyl methacrylate in the molar ratio 2:1, or methacrylic acid and ethyl acrylate in the ratio of 1:2. An example of a product of the thickening agents, based on acrylic acid and polyallyl sugar ethers, is that copolymer which has approximately 1% of polyallylsucrose having an average of 5.8 allyl groups with acrylic acid.

The preferred thickening agents are those copolymers of the specified composition which, owing to their structure and their degree of polymerization, have a viscosity of at least 500 cP, particularly of from 1000 to 30,000 cP, when measured in a 3% aqueous solution at a pH of 7 to 9 and at 20° C. Such products are commercially available.

The liquid, pourable cleaning agents contain water-soluble inorganic and organic bases in accordance with the above definition for the purpose of salt formation and thus for rendering the thickening agents, used in accordance with the invention, water-soluble. These bases, such as the alkali metal hydroxides, particularly sodium and potassium hydroxide, and/or alkylamines or alkylolamines, such as mono, di and triethanolamine, may be present in the liquid preparations in super-stoichiometric amounts relative to the amount necessary to form the corresponding salts with the copolymers, whereby they contribute to the increase in the alkalinity and thus to assisting the cleaning action of the preparation. An optimum cleaning action, suspension stability and satisfactory skin compatibility is obtained when the amounts of the bases are proportioned in sufficient excess, such that the liquid preparations have a pH value of from 9 to 11.

The surface-active compounds or tensides incorporated in the cleaning agents in accordance with the invention contain, in the molecule, at least one hydrophobic organic moiety and one anionic, zwitterionic or non-ionic group rendering the cleaning agents soluble in water. The hydrophobic moiety is usually an aliphatic hydrocarbon moiety having 8 to 26, preferably 10 to 22, and particularly 12 to 18 carbon atoms, or an alkylphenyl radical having 6 to 18, preferably 8 to 16, aliphatic carbon atoms.

By way of example, soaps from natural or synthetic, preferably saturated fatty acids and, optionally, from resinic or naphthenic acids are suitable as anionic tensides. Suitable synthetic anionic tensides are those of the type of sulfonates, sulfates and synthetic carboxylates.

Suitable tensides of the sulfonate type are alkylbenzene sulfonates ($C_{9-15}$-alkyl), mixtures of alkene sulfonates and hydroxyalkane sulfonates, as well as alkane disulfonates which are obtained, for example, from monoolefins having 10 to 22 carbon atoms with either a terminal or non-terminal double bond by sulfonation with gaseous sulfur trioxide and subsequent alkaline or acid hydrolysis of the products of sulfonation. Alkane sulfonates having 10 to 22 carbon atoms are also suitable which are obtainable from alkanes by sulfochlorination or sulfoxidation and subsequent hydrolysis or neutralization or by bisulfite addition to corresponding olefins. Further usable tensides of the sulfonate type are the lower alkyl esters of $\alpha$-sulfo fatty acids, such as $\alpha$-sulfonic acids of methyl or ethyl esters of hydrogenated coconut fatty acids, hydrogenated palm kernel fatty acids or hydrogenated tallow fatty acids.

Suitable tensides of the sulfate type are the sulfuric acid monoesters of primary alkanols (for example, from coconut fatty alcohols, tallow fatty alcohols) or primary alkenols (for example, from oleyl alcohol) and those of secondary alkanols having 10 to 22 carbon atoms. Also suitable are sulfated higher fatty acid alkanolamides, sulfated higher fatty acid monoglycerides or sulfated products of the reaction of 1 to 4 mols of ethylene oxide with primary or secondary fatty higher alcohols or $C_8$–$C_{16}$ alkylphenols.

Further suitable anionic tensides are the fatty acid esters and amides of hydroxycarboxylic acids or aminocarboxylic acids or hydroxysulfonic acids or aminosulfonic acids, such as fatty acid sarcosides, fatty acid glycolates, fatty acid lactates, fatty acid taurides or fatty acid isethionates.

The anionic tensides may be present in the form of the alkali metal salts, such as the sodium or potassium salts, as well as the ammonium salts thereof, as well as water-soluble salts of organic bases, for example, alkylamines and alkylolamines discussed above, such as mono, di or triethanolamine.

The non-ionic surface-active compounds or tensides are preferably polyglycol ethers of hydrophobic aliphatic hydrocarbon moieties as discussed above. The products of addition of 4 to 40, preferably 4 to 20, mols of ethylene oxide to 1 mol of a fatty alcohol, an alkylphenol, a fatty acid, a fatty amine, a fatty acid amide, or an alkanesulfonamide may be used as non-ionic tensides. Particular importance is attached to the products of addition of 5 to 16 mols of ethylene oxide to coconut or tallow fatty alcohols, to oleyl alcohol or to secondary alkanols having 8 to 18, preferably 12 to 18 carbon atoms, and to mono or dialkylphenols having 6 to 14 carbon atoms in the alkyl radicals.

However, in addition to these water-soluble non-ionics, polyglycol ethers which are not water-soluble, or which are not fully water-soluble, and which have a 1 to 4 ethylene glycol ether radicals in the molecule, are of interest, particularly when they are used together with water-soluble non-ionic or anionic tensides. Also usable as non-ionic tensides are the water-soluble block polymers of ethylene oxide and propylene oxide, such as the products of addition, containing 20 to 250 ethylene glycol ether groups and 10 to 100 propylene glycol ether groups, of ethylene oxide to polypropyleneglycol, to alkylenediaminepolypropyleneglycol and to alkylpolypropyleneglycols having 1 to 10 carbon atoms in the alkyl chain, in which the polypropyleneglycol chain acts as a hydrophobic radical.

The non-ionic tensides which may be used also include the fatty acid alkylolamides having one or two hydroxyethyl or hydroxypropyl groups, such as coconut and tallow fatty acid ethanolamide and diethanolamide, oleic acid diethanolamide, etc., and compounds which are derived from other polyhydroxyalkylamines, such as glycamines.

Suitable non-ionic tensides are also the surface-active amine oxides which are usually derived from tertiary amines having a hydrophobic $C_{10}$–$C_{20}$-alkyl group and two shorter alkyl and/or alkylol groups each containing up to 4 carbon atoms. Typical representatives are, for example, the compounds:

N-dodecyl-N,N-dimethylamine oxide
N-tetradecyl-N,N-dihydroxyethylamine oxide
N-hexadecyl-N,N-bis-(2,3-dihydroxypropyl)-amine oxide.

Suitable zwitterionic surface-active compounds or tensides contain in the molecule, in addition to a hydrophobic, usually aliphatic group, both hydrophilic acid groups, such as carboxyl, sulfo, sulfuric acid semi-ester, phosphono, or phosphoric acid partial ester groups, and basic hydrophilic groups, such as amino, imino or ammonium groupings. Zwitterionic compounds having a fourfold substitution, i.e., quaternary ammonium groups, include the betaine type when they also have in the molecule a covalent bound acid group and the positive and negative charge is balanced intramolecularly. In a wider sense, the betaine class also includes the correspondingly substituted quaternary phosphonium and tertiary sulfonium compounds.

Owing to their good cleaning properties and their good compatibility with other tensides, particular importance is attached to the carboxy betaines, sulfonate betaines and sulfate betaines with nitrogen. Typical representatives of zwitterionic tensides are, for example, the compounds:

3-(N-hexadecyl-N,N-dimethyl-ammonio)-propane sulfonate
3-(N-hexadecyl-N,N-bis-[2-hydroxyethyl]-ammonio)-2-hydroxypropyl sulfate
3-(N-coconut alkyl-N,N-bis-[2,3-dihydroxypropyl]-ammonio)-propane sulfonate
N-tetradecyl-N,N-dimethyl-ammonio-acetate.

In less preferred embodiments, the abrasive component, used in accordance with the invention and comprising fine-particulate cristobalite, can be partially replaced, i.e., approximately up to half the quantity, by other conventional water-insoluble finely-ground minerals which have a mechanical cleaning action, such as quartz, feldspar, marble, fluorite, kaoline or pumice. Alternatively, these inorganic abrasive substances can be replaced by subordinate quantities of finely-ground water-insoluble organic synthetic polymers, such as polyethylene and polypropylene powder or the mineral abrasive substances coated with a film of synthetic resin. The advantages of cristobalite are still clearly shown even when using such mixtures of abrasive substances where the cristobalite amounts to 60%, preferably 75% to 100%, by weight of the abrasive component.

The present invention will now be further described by means of the following examples. These examples are not limitative in any manner.

EXAMPLES

The compositions and the methods of producing some liquid cleaning agents will be specified in the following examples for the purpose of explaining the invention. The viscosities were measured in a Brookfield viscosimeter, Model RVT, spindle number 4, at 20 r.p.m. and 20° C.

EXAMPLE 1

This example describes a storage-stable, white, homogeneous suspension produced by mixing the individual components, wherein, advantageously, a specific mixing sequence was observed. This composition was:

| Percent by Weight | |
|---|---|
| 3.0 | Coconut fatty alcohol ($C_{16}$–$C_{18}$) + 10 EO |

-continued

| Percent by Weight | |
|---|---|
| | (EO = ethylene oxide) |
| 0.45 | Copolymer of 1 mol of methacrylic acid and 2 mols of ethyl acrylate (viscosity of the 1% solution in water at 20° C and pH 9: 5,500 to 14,000 cP) |
| 1.5 | Diethanolamine |
| 50.0 | Cristobalite powder, grain size up to a maximum of 100 μ |
| | Remainder - demineralized water. |

In order to produce the agent, the water was introduced, less the amount required to produce a 30% dispersion of the copolymer, to the mixing vessel. The non-ionic tenside and the organic base were then introduced under agitation. The cristobalite powder was added to this mixture. The thickening agent was then added slowly under agitation. The mixture became increasingly thick. The viscosity of the product was 5,000 cP; pH 10 to 10.5.

EXAMPLE 2

A white, homogeneous, storage-stable suspension was obtained by mixing the individual components by the method described in Example 1:

| Percent by Weight | |
|---|---|
| 4.0 | Nonylphenol + 9.5 EO |
| 0.27 | Copolymer of Example 1 |
| 0.9 | Diethanolamine |
| 0.2 | Formalin (as 30% solution) |
| 0.2 | Perfume |
| 30.0 | Cristobalite powder, grain size up to a maximum of 100 μ |
| 20.0 | Cristobalite powder, grain size up to a maximum of 150 μ |
| | Remainder - demineralized water. |

Viscosity of the product 3,300 cP; pH 10 to 10.5.

EXAMPLE 3

A white, homogeneous, storage-stable suspension of the following composition was obtained by mixing the constituents in the manner specified below:

| Percent by Weight | |
|---|---|
| 2.0 | Nonylphenol + 9.5 EO |
| 0.05 | Sodium hydroxide |
| 1.0 | A polymer from 99% by weight of acrylic acid and !% by weight of allylsucrose (average 5.8 allyl groups per molecule), molecular weight approximately 1,000,000 |
| 45.0 | Cristobalite powder, grain size up to a maximum of 100 μ |
| 0.2 | Perfume |
| | Remainder - demineralized water. |

For the purpose of production, the tenside was first dissolved in the water after holding back the quantity of water required to produce a 10% caustic soda solution. The thickening agent was introduced under agitation into the tenside solution, and the caustic soda solution was subsequently added. A clear solution was then formed having an increased viscosity. After introducing the perfume, the cristobalite powder was added and agitation was effected until an homogeneous distribution was obtained.

If the cristobalite powder, used in accordance with the invention, is replaced in the formulations of the specified examples by a marble powder having a grain size distribution up to a maximum of 140 μ, in order to ensure a comparable cleaning action of the product owing to the inferior hardness of the marble (hardness 3 of the Mohs' scale), these preparations exhibit, even after a short period of storage at room temperature, sedimentation of the coarser portions of the abrasive substance of the marble with the formation of a sediment which, finally, cannot be shaken up. The preparations in accordance with the invention meanwhile remain fully suspension-stable for this period of time. Replacing the cristobalite powder by quartz powder results in products which have a dirty, greyish-brown appearance irrespective of the composition of surfactant component, while the products in accordance with the invention have a pure white appearance.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. A liquid scouring cleaning composition consisting essentially of (a) from 30% to 60% by weight of cristobalite having a grain size of less than 150 μ and without a substantial proportion of particles having a grain size of less than 5 μ, (b) from 1% to 10% by weight of at least one non-ionic surface-active compound (c) from 0.1% to 2% by weight of a water-soluble polycarboxylate polymeric thickening agent, and (d) from 27% to 68.9% by weight of a predominantly aqueous liquid carrier, said liquid composition having a pH of between 9 and 11.

2. The liquid scouring cleaning composition of claim 1 wherein said predominantly aqueous liquid carrier is water.

3. The liquid scouring cleaning composition of claim 1 wherein said composition contains from 0.1 to 5% by weight of at least one conventional scouring cleaning composition additive of the following type: water-soluble inorganic bases, water-soluble organic bases, foam stabilizers, preservatives, antimicrobial agents, perfumes, dyes, water-soluble inorganic alkaline-reacting alkali metal salts, organic complex-forming acids and their alkali metal salts.

4. A liquid scouring agent composition consisting essentially of:

(a) from 35% to 50% by weight of cristobalite having a grain size of less than 100 μ and over 5 μ, (b) from 1% to 6% by weight of at least one non-ionic surface-active compound, (c) from 0.1% to 1.5% by weight of a water-soluble polycarboxylate polymeric thickening agent, (d) from 40% to 63.9% by weight of water, and (e) from 0 to 20% by weight of a water-soluble organic solvent, said liquid composition having a pH of between 9 and 11.

5. The liquid scouring cleaning composition of claim 4 wherein said water-soluble polycarboxylate polymeric thickening agent is a copolymer based on a monomeric acid selected from the group consisting of acrylic acid, methacrylic acid, and mixtures thereof, which contains, in addition to acryl and/or methacryl monomer units, from 25 mol percent to 75 mol percent of monomer units selected from the group consisting of lower alkyl acrylates, lower alkyl methacrylates, and mixtures thereof.

6. The liquid scouring cleaning composition of claim 4 wherein said water-soluble polycarboxylate polymeric thickening agent is a copolymer of acrylic acid containing from 0.2% to 2.5% by weight of polyallylpolysugar ether monomer units.

* * * * *